US006790110B2

(12) United States Patent
Ozawa

(10) Patent No.: US 6,790,110 B2
(45) Date of Patent: Sep. 14, 2004

(54) MARINE POWER STEERING SYSTEM

(75) Inventor: Kazuho Ozawa, Kakegawa (JP)

(73) Assignee: Sogi Kabushiki Kaisha, Kakegawa (JP)

( * ) Notice: Subject to any disclaimer, the term of this patent is extended or adjusted under 35 U.S.C. 154(b) by 0 days.

(21) Appl. No.: 10/249,236

(22) Filed: Mar. 25, 2003

(65) Prior Publication Data

US 2003/0186600 A1 Oct. 2, 2003

(30) Foreign Application Priority Data

Mar. 28, 2002 (JP) ..... 2002-090851

(51) Int. Cl.[7] ..... B63H 20/08

(52) U.S. Cl. ..... 440/61 S; 440/61 A; 440/61 C; 114/150; 114/144 E

(58) Field of Search ..... 114/144 R, 150, 114/144 RE, 144 E; 440/53, 61 R, 61 S, 61 A, 61 B, 61 C, 63, 900; 74/388 PS

(56) References Cited

U.S. PATENT DOCUMENTS 3,706,263 A * 12/1972 Johnson ..... 91/388
4,004,537 A * 1/1977 Nilsson ..... 114/144 R
4,419,084 A * 12/1983 Borst ..... 440/58
4,933,617 A * 6/1990 Huber et al. ..... 318/588
5,031,562 A * 7/1991 Nakase et al. ..... 114/150
5,057,043 A * 10/1991 Sugimoto et al. ..... 440/61 R
5,127,856 A * 7/1992 Kabuto et al. ..... 440/60
5,146,745 A * 9/1992 Doetsch ..... 60/403
5,228,405 A * 7/1993 Merten ..... 114/150
5,240,445 A * 8/1993 Aoki et al. ..... 440/58
5,244,426 A * 9/1993 Miyashita et al. ..... 440/60
5,253,604 A * 10/1993 Bohlin ..... 114/144 E
5,266,060 A * 11/1993 Onoue ..... 440/61 R
5,328,394 A * 7/1994 Onoue et al. ..... 440/61 R
5,340,341 A * 8/1994 Yoshimura ..... 440/61 R
5,350,326 A * 9/1994 Funami et al. ..... 440/61 R
5,387,142 A * 2/1995 Takayanagi et al. ..... 440/61 R
5,427,555 A * 6/1995 Merten ..... 440/61 R
5,427,556 A * 6/1995 Ishikawa et al. ..... 440/62
5,447,456 A * 9/1995 Nakayasu ..... 440/61 R
5,505,641 A * 4/1996 Onoue ..... 440/61 R
5,605,109 A * 2/1997 Merten et al. ..... 114/150

FOREIGN PATENT DOCUMENTS

JP 56138097 A * 10/1981 ..... B63H/25/30
JP 58161696 A * 9/1983 ..... B63H/25/30
JP 03099997 A * 4/1991 ..... B63H/25/30

* cited by examiner

*Primary Examiner*—S. Joseph Morano
*Assistant Examiner*—Ajay Vasudeva
(74) *Attorney, Agent, or Firm*—Ernest A. Beutler

(57) ABSTRACT

An improved and simplified marine power steering device that provides assist by selectively operating an electric motor driven hydraulic motor to provide the assist. This eliminates pumps that are constantly driven by the watercraft engine. Also the entire assist unit is formed as a single assembly to minimize the hydraulic conduits and their assembly.

10 Claims, 6 Drawing Sheets

MARINE POWER STEERING SYSTEM

BACKGROUND OF INVENTION

This invention relates to a marine power steering system and more particularly to an improved, compact, high efficiency hydraulically assisted system.

There have been proposed power assisted marine steering systems. These types of systems generally employ hydraulic assist motors that are mechanically coupled to the watercraft steering device to apply a force that assists the manual inputted steering force. These prior art systems have several disadvantages as will become apparent by reference to FIG. 1, that shows a conventional type of system now used.

Referring now to FIG. 1, a manually operated steering control, such as a steering wheel 11 is mounted in the operator's area of the associated watercraft and its output is connected to a vessel steering device 12 by a Bowden wire actuator, indicated generally at 13. The watercraft steering device 12 may comprise any known type of watercraft steering device such as a rudder or pivotally supported propulsion device such as an outboard motor or the outboard drive portion of an inboard outboard drive.

The Bowden wire actuator is comprised of an inner, actuating wire 14 and a surrounding protective sheath 15. One end of the inner wire is connected to the steering wheel 11 and the other end is connected to the watercraft steering device 12. These connections are of any known type.

A hydraulic assist motor 59 is also connected to the vessel steering device 12 to assist in the steering operation. The assist motor is generally a reciprocating motor comprised of an outer cylinder 17 having a cylinder bore 18 in which a piston 19 is reciprocally mounted to define a pair of fluid chambers 21 and 22. During steering assist one or the other of the chambers 21 and 22 is pressurized and the fluid from the other is returned to an oil reservoir 23. How this is done will be described shortly.

A piston rod 24 is connected to the piston 19 at one end and extends through the chamber 22, externally of the cylinder 17 for connection to the vessel steering device 12.

The power assist is controlled by controlling the pressurization of either the chamber 21 or 22 from a fluid pump 25 that is continuously driven by an engine 26 which generally is the engine that powers the associated watercraft. The supply and return of the fluid to the motor 26 is controlled by a spool valve, indicated generally at 27. The spool 28 of the valve 27 is connected to the sheath 15 of the Bowden wire actuator 13. As is well known, the force applied to the wire 14 from the steering wheel 11 causes a reactive force on the sheath 15 and this force is utilized to actuate the valve spool 28.

This type of system has a number of disadvantages. For example, the hydraulic pump 25 is constantly driven by the engine 26 while the engine 26 is powering the watercraft, resulting in loss of the engine output. In addition, the hydraulic cylinder 16 and the hydraulic pump 25 are separately installed in the watercraft requiring, complicated hydraulic piping arrangement for connection. This also results in more burdensome installation as well as a risk of foreign matter entering into the hydraulic circuit.

It has been proposed to utilize an electric motor to drive the pump 25, but this does not simplify the plumbing problems. In addition the motor is operated continuously to insure the availability of hydraulic assist, putting added load on the watercraft electrical system and its batteries. Also it means that the system must be constantly pressurized and this reduces the life of the system.

It is, therefore, a principal object of this invention to provide an improved and simplified water craft steering assist system that has a reduced and simplified hydraulic system and a simplified control and operator therefore.

SUMMARY OF INVENTION

This invention is adapted to be embodied in an assisted marine steering system that is comprised of a manually operated steering control, a watercraft steering device controlling the direction of travel of a watercraft and a manual connection between the manually operated steering control and the watercraft steering device for manually operating the watercraft steering device. A force sensor is provided for sensing the manual force applied to the manually operated steering control. A hydraulic assist motor is coupled to the watercraft steering device for applying a hydraulic assist to the steering operation thereof. Finally, a control varies the amount of hydraulic assist outputted to the watercraft steering device by the hydraulic assist motor in response to the amount of manual force sensed by the force sensor.

DETAILED DESCRIPTION

Figure 1:
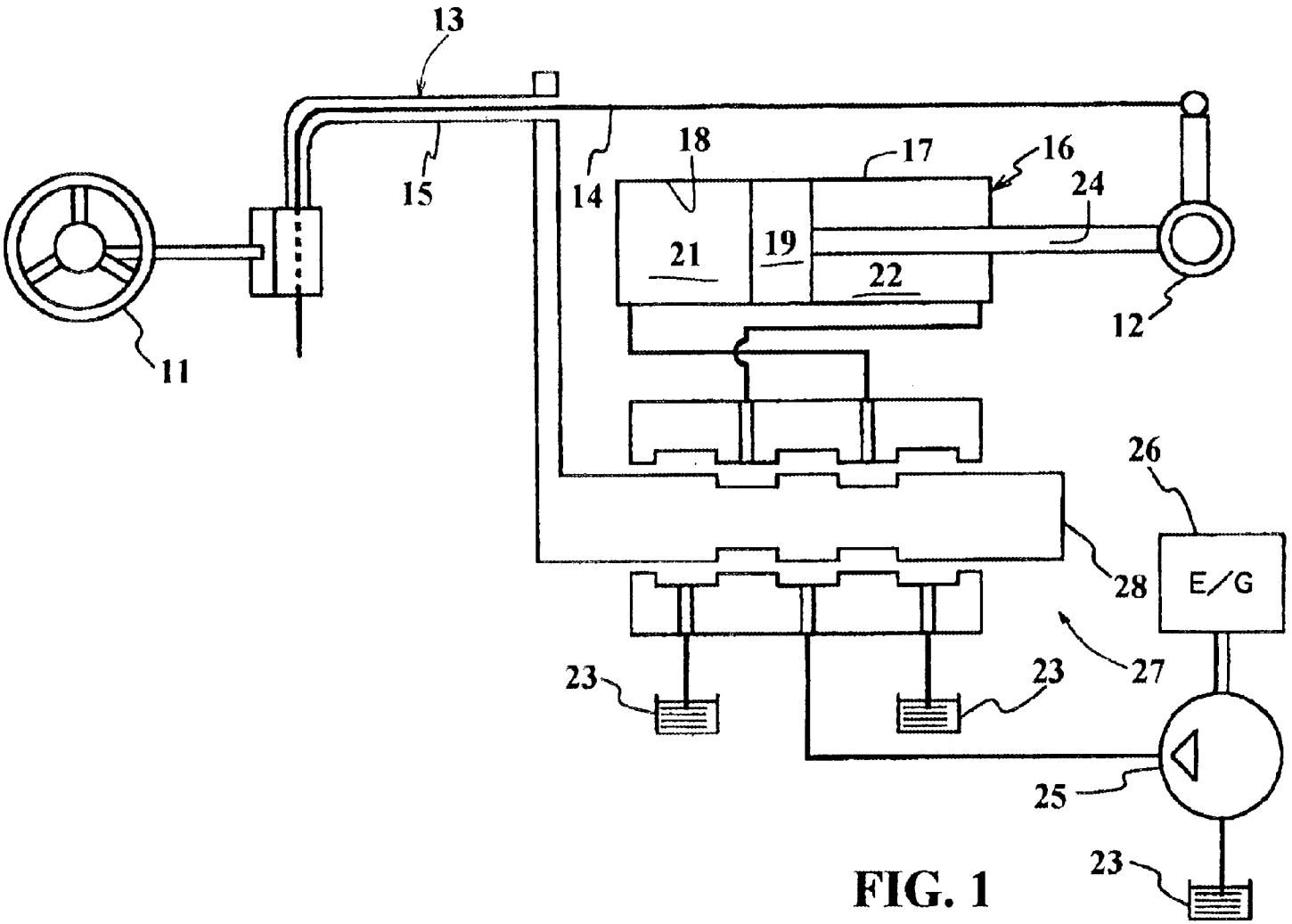
FIG. 1 PRIOR ART
FIG. 1 is a partially schematic, cross sectional view of a prior art type of watercraft power steering system.
Figure 2:
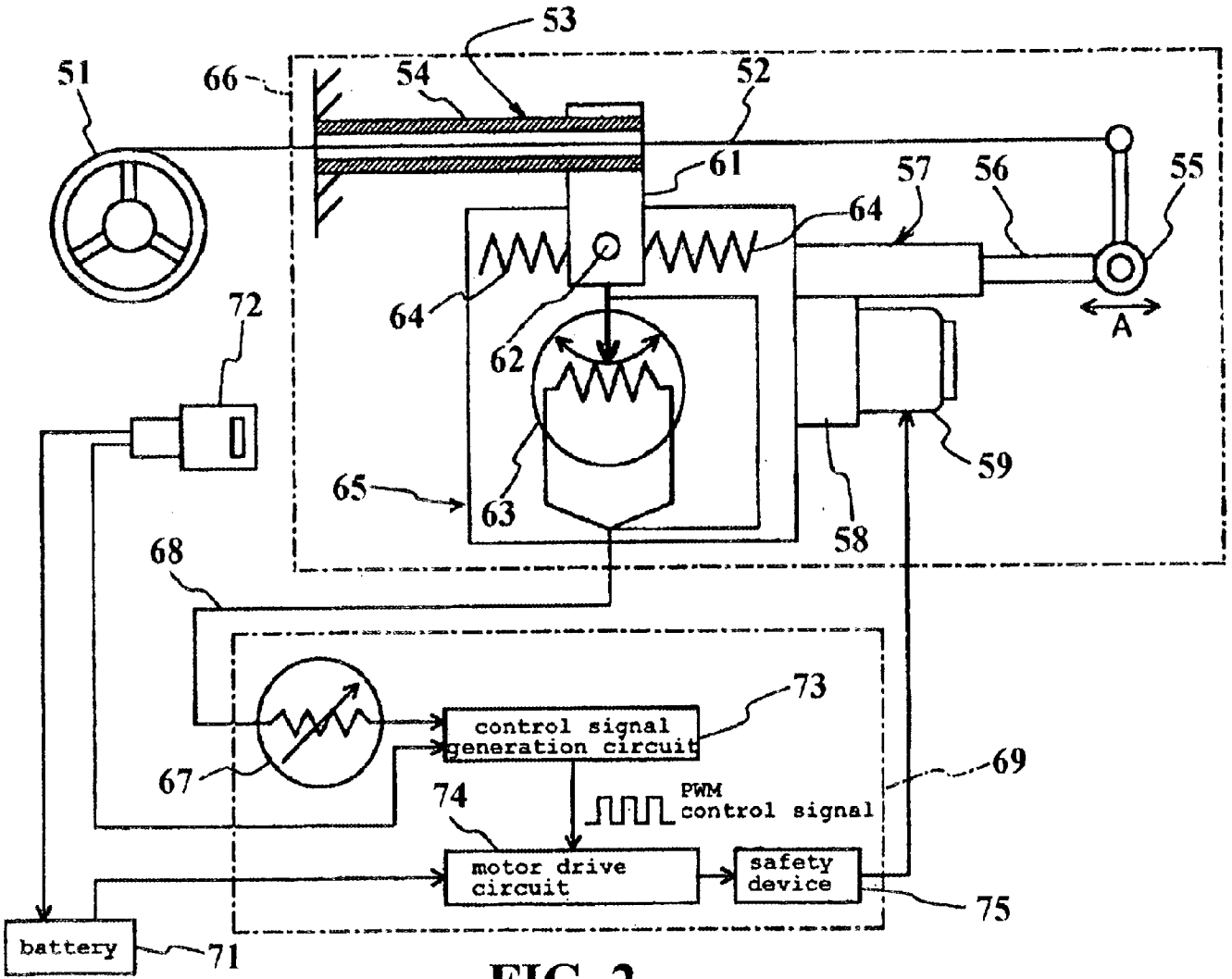
FIG. 2 is a partially schematic, cross sectional view, in part similar to FIG. 1, but shows a system embodying the invention.

Referring now in detail to the drawings and initially to FIG. 2, a steering control such as a steering wheel 51 is connected to the inner wire 52 of a Bowden wire actuator, indicated generally by the reference number 53. The inner wire 52 is received in a sheath 54 to be connected to a steering device (not shown in this figure) in the boast via a connection 55. Tho push-pull type of inner wire 52 is operated in its push and pull directions. Operating the steering wheel 51 to drive the connection 55 in the directions shown by the arrow A allows the drive to rotate around its swivel shaft (not shown in this figure). Therefore, the thrust direction of the drive is changed to steer the boat.

The piston rod 56 of a hydraulic cylinder assembly, indicated generally at 57, is also connected to the connection 55. The hydraulic cylinder 57 serves as a steering assist to the steering wheel 51 and drives the connection 55 in the directions shown by the arrow A to provide auxiliary, assist power in response to the steering force from the steering wheel 51. A hydraulic pump 58 supplies hydraulic pressure to the hydraulic cylinder 57 as required in a manner to be described. The hydraulic pump 58 is driven by a reversible electric motor 59.

A link 61 is connected to the protective sheath 54. The link 61 is pivotal about a rotational shaft 62. When the steering wheel 51 is rotated by a force exceeding a value preset, in a manner to be described, it provides either a pulling force or a pushing force that acts on the inner wire 52. In practice, the protective sheath 54 for guiding the inner wire 52 does not move linearly but bends at an angle of, for example, 90 degrees. Thus, when the inner wire 52 is subjected to pulling force or pushing force the protective sheath 54 is acted on accordingly thereby producing reactive force.

Therefore, the link 61 connected to the sheath 54 rotates around the rotational shaft 62 by force equal to the reactive force. The degree of rotation of the link 61 is detected as a change in electrical resistance by a variable resistor 63. Thereby, the steering force in the inner wire 52 according to the steering force for the steering wheel is detected. The steering force corresponds to the displacement of the link 61 rotating between positions. Thus, the positions of the link 61 are detected by the potentiometer (the variable resistor 63 in this embodiment), so that the steering force for the steering wheel is detected to provide auxiliary steering power accordingly.

A pair of oppositely acting springs 64 are disposed on opposite sides of the link 61 to adjust the steering force applied to the steering wheel 51 necessary to effect steering, as above noted. Thus the link 61 and the variable resistor 63 described above make up a steering force sensor, indicated generally by the reference numeral 65. The steering force sensor 65 is preferably integrally connected to the above hydraulic cylinder 57, the hydraulic pump 58 and electric motor 59 to form into a unit of single-piece configuration, indicated generally at 66.

The output of the variable resistor 63 in the steering force sensor 65 is connected to a variable resistor 67 in a controller 69 by a conductor 68 for controlling the drive of the electric motor 59. The variable resistor 67 is designed to adjust the stand-still position of the motor 59. The variable resistor 67 for adjusting the stand-still position of the motor is designed to correct installation errors of the variable resistor 63 in the steering force sensor 65, and to adjust to the input value for which no steering force is produced in the inner wire 52.

The controller 69 is supplied with electric power from a watercraft battery 71 under the control of a key controlled switch 72. The controller 69 has a control signal generation circuit 73 to which the output of the variable resistor 67 is connected or integrally incorporated. Its output is delivered to a motor drive circuit 74 connected to the circuit, and a safety device 75. The control signal generation circuit 73 calculates the amount of controlling of the electric motor 59 according to the control input (the tension of the inner wire 52 detected by the steering force sensor 65 to generate pulse width modulation signals as motor control signals.

PWM signals generated are inputted to the motor drive circuit 74 to control motor current by an FET. The motor drive circuit 74 drives the electric motor 59 by control current according to the steering force via the safety device 75 comprised of fuses and relays.

When input to the controller 69 is changed depending on changes in steering force, the electric current changed with the input operates the motor 59. The hydraulic cylinder 57 is allowed to extend or retract in the direction to restore the link 61 and the hydraulic cylinder 57 to their original relative location, which reduces steering force required for the steering wheel 51. When the variable resistor 63 is returned to the neutral position, the operation of the electric motor 59 and pump 58 is stopped.

Having described the general construction and operation by reference to the primarily schematic FIG. 2, more detailed description of the physical structure will now be made by reference to the remaining, more detailed figures and initially, primarily to FIG. 3. As has been noted, the system body 66 is configured as a power steering unit of single-piece configuration in which the hydraulic cylinder 57, the hydraulic pump 58, the electric motor 59 and the steering force sensor 65 are integrally connected. The power steering unit 66 (system body) is mounted inside on the transom board of the boat via three mounting holes 76. The connection 55, to which the inner wire 52 and the piston rod 56 of the hydraulic cylinder 57 are both connected, is connected to a steering section 77 of the boat via a steering rod 78.

The output shaft of the electric motor 59 is connected to the hydraulic pump 58 via a dog clutch 79. The protective sheath 54 is connected to a wire mounting section 81 in the steering force sensor 65. Rather than operating on the lever 61, as previously described, the wire mounting section 81 is connected to a transmission arm 82 and a transmission shaft 83 integral with the transmission arm. The transmission shaft 83 has a drive gear 84 (not shown in FIG. 3 but see FIG. 4) attached to its end 83*a*. The drive gear 84 is connected to the variable resistor 63 via a driven gear 85.

The variable resistor 63 in the steering force sensor 65 is connected to the variable resistor 67 (FIG. 2) in the controller 69 via the wire 68. The controller 69 is, as previously described, made up of a control circuit 86 including the variable resistor 67 and the control signal generation circuit 74 (FIG. 2) and a driver 87 that includes the motor drive circuit 74 and the safety device 75 (FIG. 2)The detailed construction of the steering force sensor 65 will now be described by reference to FIG. 4. The wire mounting section 81 to which the protective sheath 54 is connected, is coupled via the transmission arm 82 and the transmission shaft 83 integral with the transmission arm 82 to the drive gear 84 at the end 83*a* of the transmission shaft (FIG. 3). The drive gear 84 is engaged with the driven gear 85 to rotate the variable resistor 63. The variable resistor 63 is, as described above, connected to the controller 69 via the wire 68.

Figure 4:
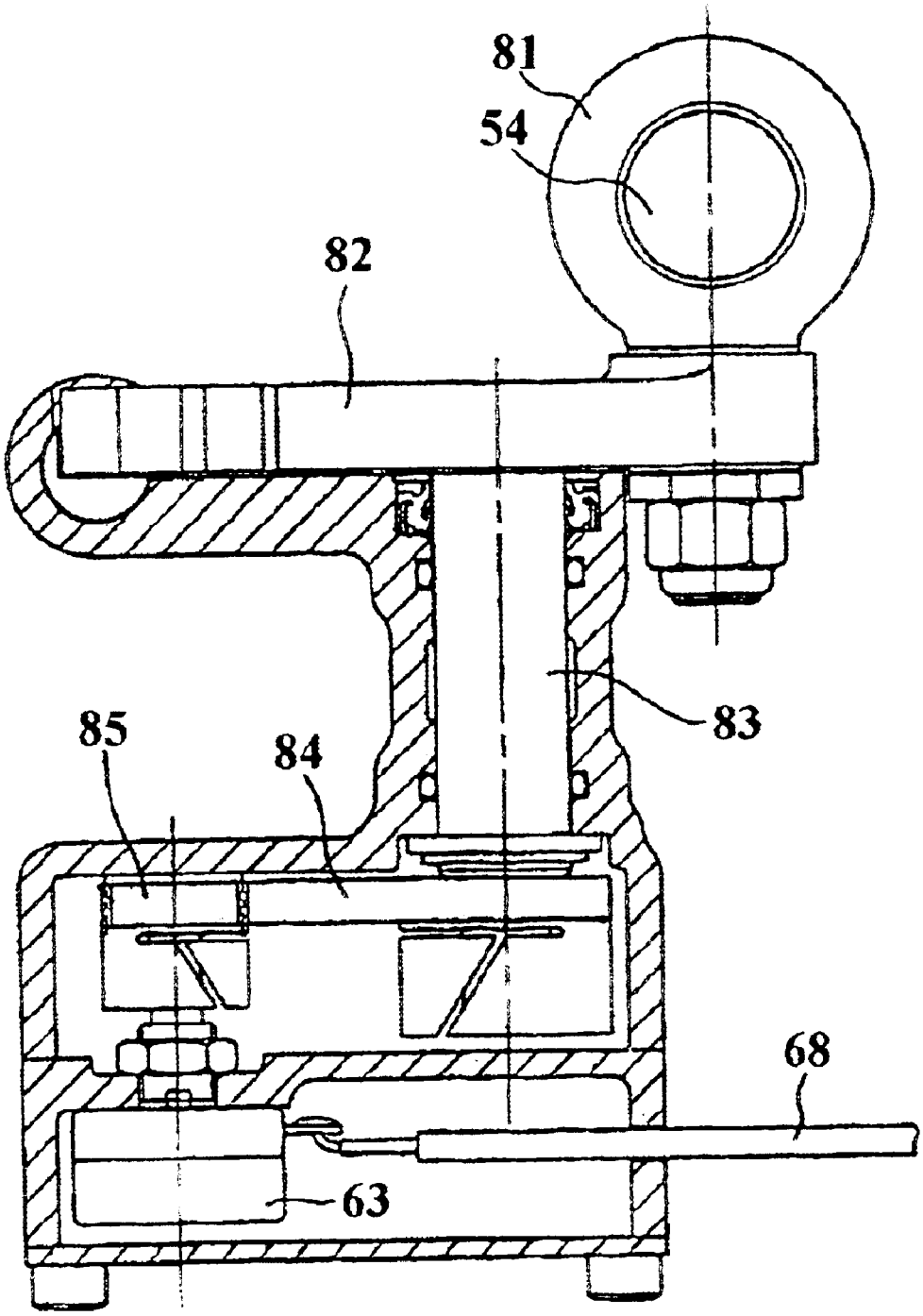
FIG. 4 is an enlarged cross sectional view showing the connection of the protective sheath to the force sensor and the output thereof.
Figure 5:
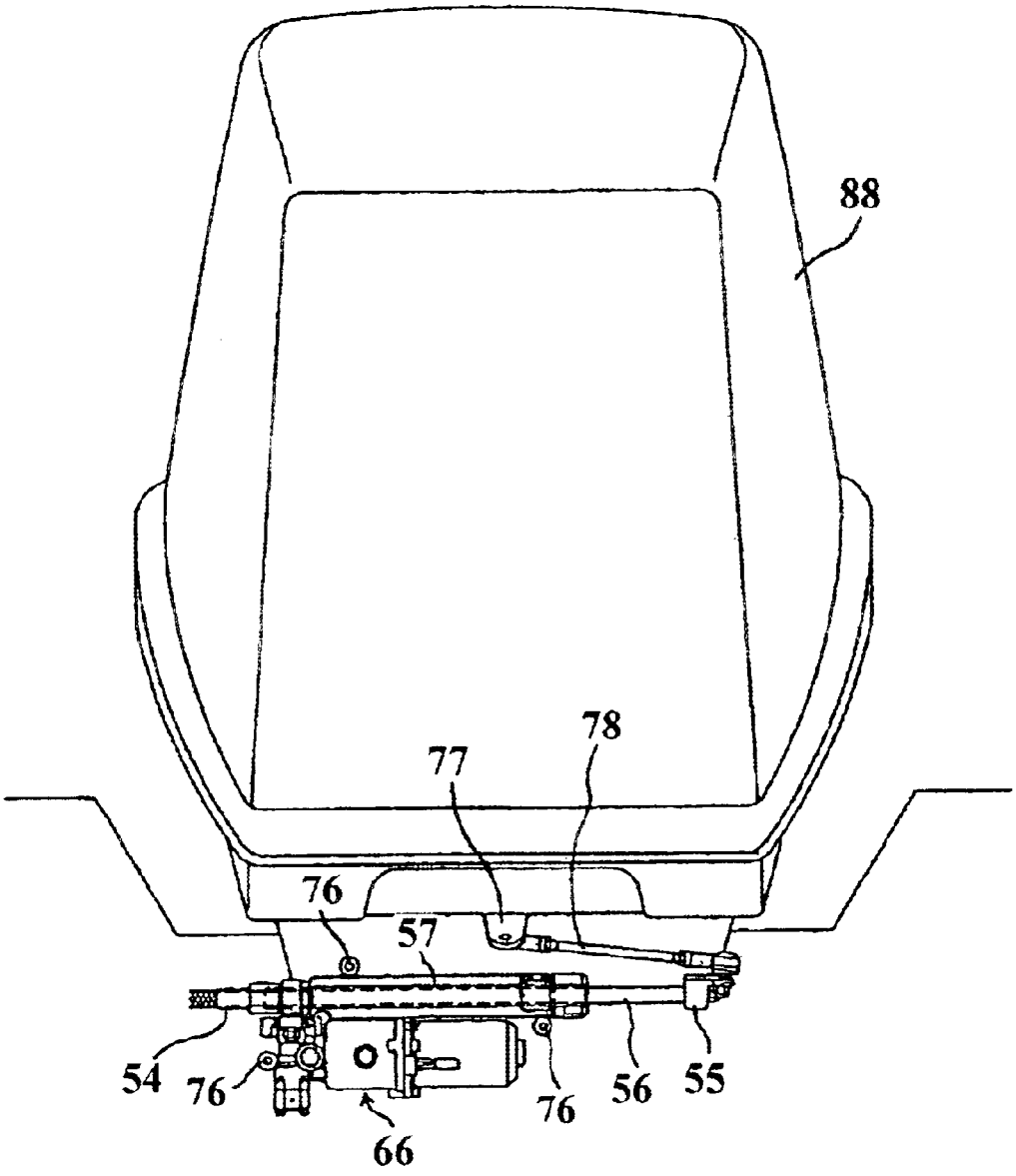
FIG. 5 is a top plan view in part similar to FIG. 3 but shows the actual connection to the watercraft steering device, in this case an outboard motor.

The actual connection to the watercraft steering device will now be described by reference to FIG. 5. FIG. 4 is a top view in which the power steering unit of the invention is mounted.

Figure 3:
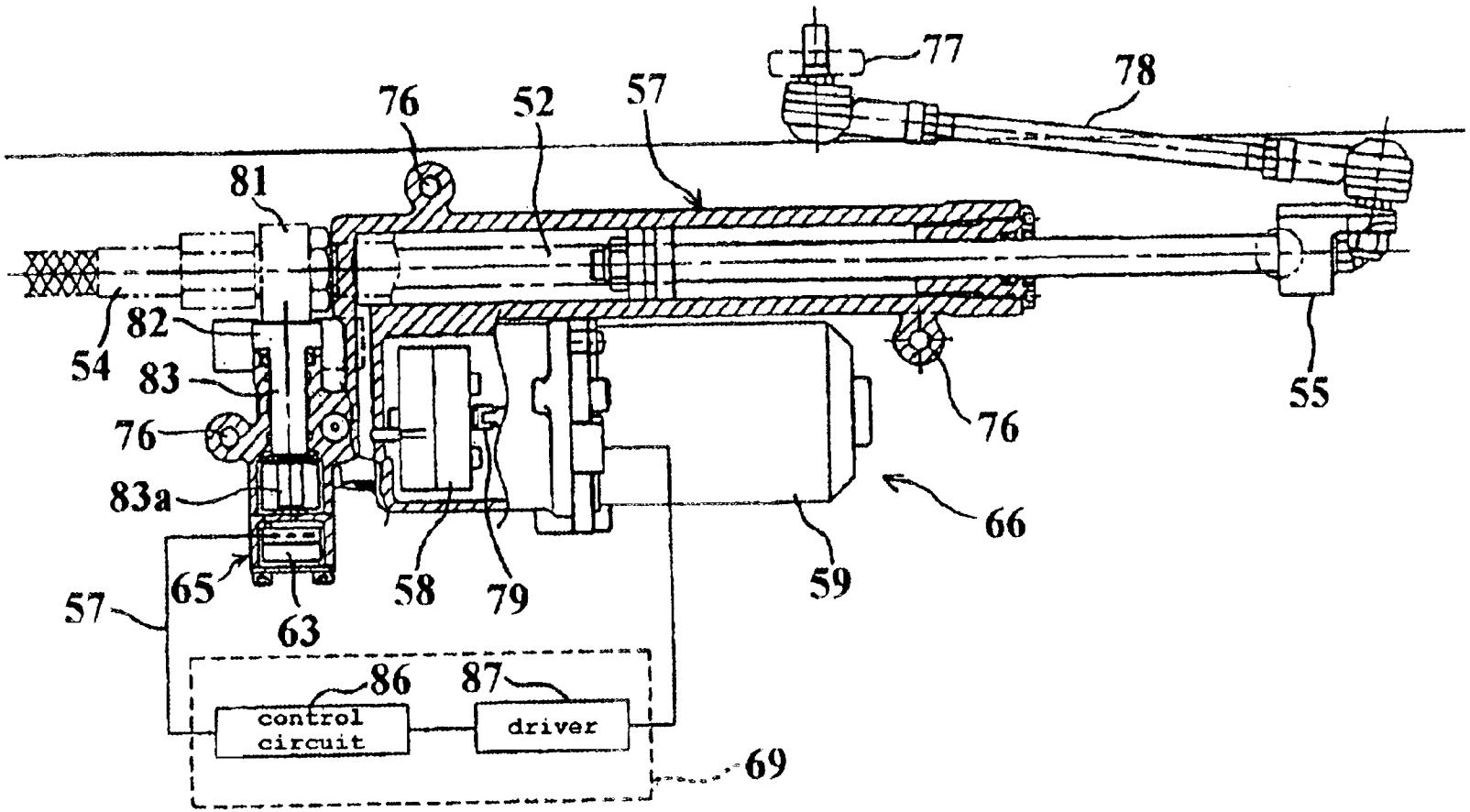
FIG. 3 is a cross sectional view showing how the power assist mechanism is integrated into the watercraft steering system.

The above power steering unit 66 as shown in FIG. 3 is mounted inside on the transom board through the three mounting holes 76. A piston rod 56 of the hydraulic cylinder 57 is coupled to the steering rod 78 via the connection 55. The steering rod 78 is coupled to the steering section 77 of the steering unit, which in this case comprises an outboard motor 88 to steer the boat.

Figure 6:
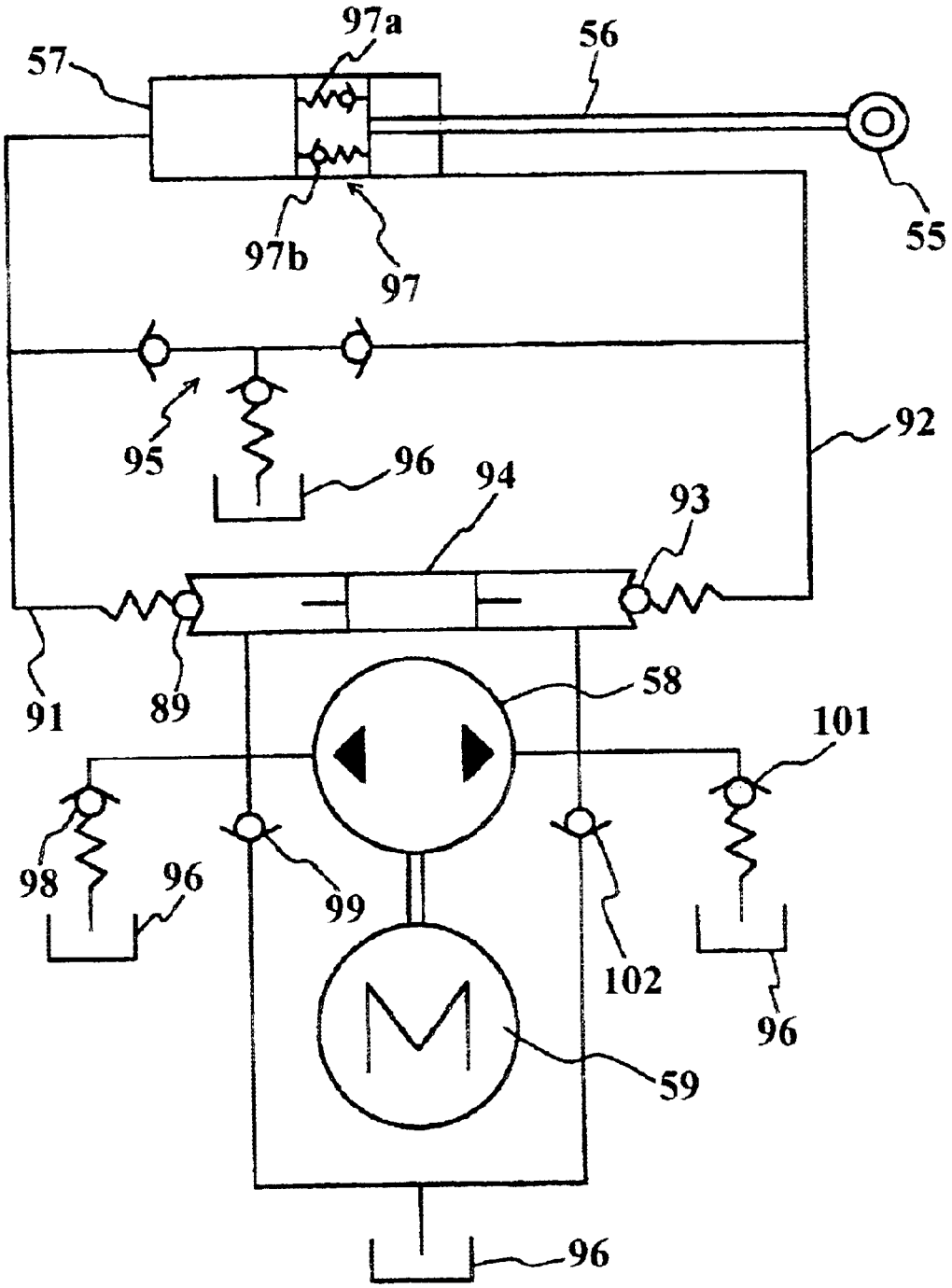
FIG. 6 is a schematic hydraulic diagram of the system.

The hydraulic circuit associated with the steering assist system will now be described by particular reference to FIG. 6. The hydraulic pump 58 is driven by the electric motor 59 as described above. The electric motor 59 is a reversible DC motor and the hydraulic pump 58 is driven by the electric motor 59 either in the reverse or forward direction depending on the desired direction of turning determined by the direction of rotation of the steering control 51.

The hydraulic pump 58 communicates with one chamber of the hydraulic cylinder 57 via a main shuttle valve 89 and a hydraulic passage 91 on the oil discharging side when the hydraulic pressure pushes the piston rod to the right as seen in this figure. Pressure is relieved from the other side of the hydraulic cylinder 57 to the hydraulic pump 58 via a further hydraulic passage 53 and a further shuttle valve 93 on the oil returning side.

As is well known in the art a shuttle piston 94 is disposed between both the main valves 89, 93. This opens the valve on the side not pressurized when one of the main valves 89, 93 is opened by discharge pressure from the hydraulic pump. When the shuttle piston 94 is positioned in the middle, the main valves 89, 93 are closed so that oil circulation stops and the piston movement of the hydraulic cylinder 57 is stopped.

A manual valve 95 is provided between the hydraulic passages 91, 53, which allows manual steering. The manual valve 95 is communicated with an oil reservoir tank 96 (the common oil tank used for the hydraulic pump 58).

A piston 97 of the hydraulic cylinder 57 is provided with a pair of relief valve check valves 97*a*, 97*b* located in opposite orientations from each another. When the force acting from the piston rod side is larger than the hydraulic pressure from the hydraulic cylinder, the respective relief valve 97*a* or 97*b* allows the piston to operate in the opposite direction against the hydraulic pressure. This allows the steering wheel 51 to be operated by large manual steering force even if pressure is locked in the hydraulic circuit. In addition, if large external force, generated when the boat hits pieces of driftwood, acts on the drive, the drive is protected by dissipating the external force.

On one of the oil discharging sides of the hydraulic pump 58, an up-relief valve 98 and a check valve 99 are provided while a down-relief valve 101 and a check valve 102 are provided on the other side. If the pressure in the hydraulic cylinder is equal to a predetermined value or higher when steering the boat, the up-relief valve 98 and the down-relief valve 101 respectively allow oil to return to the oil tank 96 according to the amount of oil stayed in the hydraulic cylinder 57. The check valves 99, 102 refill the hydraulic cylinder 57 with oil provided from the oil tank 96 if running out of oil when the boat is steered.

Thus from the foregoing description it should be readily apparent that the described construction overcomes the problems attendant with the prior art constructions. Of course those skilled in the art will readily understand that the foregoing description is that of a preferred embodiment of the invention and that various changes and modifications may be made without departing from the spirit and scope of the invention, as defined by the appended claims.

What is claimed is:

1. An assisted marine steering system comprising a manually operated steering control, a watercraft steering device controlling the direction of travel of a watercraft, a direct mechanical connection between said manually operated steering control and said watercraft steering device for manually operating said watercraft steering device, a force sensor for sensing the magnitude of the manual force applied to said manually operated steering control, a hydraulic assist motor coupled to said watercraft steering device for applying a hydraulic assist to the steering operation thereof, and a control for varying the amount of hydraulic assist outputted to said watercraft steering device by said hydraulic assist motor in proportion to the magnitude of the manual force sensed by said force sensor.

2. An assisted marine steering system as set forth in claim 1 wherein the hydraulic assist motor is powered by an electric motor driven hydraulic pump.

3. An assisted marine steering system as set forth in claim 2 wherein the amount of hydraulic assist is varied by varying the output of the electric motor.

4. An assisted marine steering system as set forth in claim 3 wherein the output of the electric motor is varied by pulse width modulation.

5. An assisted marine steering system as set forth in claim 1 wherein the force sensor comprises a potentiometer.

6. An assisted marine steering system as set forth in claim 1 wherein the hydraulic assist motor, electric motor and control are integrated into a unit.

7. An assisted marine steering system as set forth in claim 6 wherein the hydraulic assist motor is powered by an electric motor driven hydraulic pump.

8. An assisted marine steering system as set forth in claim 7 wherein the amount of hydraulic assist is varied by varying the output of the electric motor.

9. An assisted marine steering system as set forth in claim 8 wherein the output of the electric motor is varied by pulse width modulation.

10. An assisted marine steering system as set forth in claim 9 wherein the force sensor comprises a potentiometer.

* * * * *

UNITED STATES PATENT AND TRADEMARK OFFICE

CERTIFICATE OF CORRECTION

PATENT NO. : 6,790,110 B2
DATED : September 14, 2004
INVENTOR(S) : Kazuhoo Ozawa It is certified that error appears in the above-identified patent and that said Letters Patent is hereby corrected as shown below:

Title page,
Item [73], Assignee, "Sogi" should read -- Soqi --

Column 2,
Line 49, "boast" should read -- boat --

Signed and Sealed this

Seventh Day of December, 2004

JON W. DUDAS
*Director of the United States Patent and Trademark Office*